US005192080A

United States Patent [19]

Duncan

[11] Patent Number: 5,192,080

[45] Date of Patent: Mar. 9, 1993

[54] BASKETBALL TYPE GAME

[76] Inventor: Don Duncan, 22718 SW. Johnson Rd., West Linn, Oreg. 97068

[21] Appl. No.: 844,454

[22] Filed: Mar. 2, 1992

[51] Int. Cl.[5] ..... A63B 67/00

[52] U.S. Cl. ..... 273/412; 273/1.5 R; 273/402; 273/DIG. 24

[58] Field of Search ..... 273/412, 414, 1.5 R, 273/1.5 A, 321, 329, 330, 402, 398, 399, 400, DIG. 24

[56] References Cited

U.S. PATENT DOCUMENTS

| | | | |
|---|---|---|---|
| 716,645 | 12/1902 | Ransom | 273/DIG. 24 |
| 2,247,852 | 7/1941 | Saunders | 273/412 |
| 2,570,860 | 10/1951 | Redding | 273/329 |
| 3,244,420 | 4/1966 | Poynter | 273/402 |

*Primary Examiner*—William H. Grieb
*Attorney, Agent, or Firm*—Eugene M. Eckelman

[57] ABSTRACT

A reduced sized backboard has a corresponding sized reduced hoop supported thereon and also has an integral handle depending from the lower end thereof which allows a person to hand-hold the backboard in an upright position and maneuver it so that a reduced sized ball traveling toward the person can by skill of the person be caused to pass through the hoop. The handle also has an integral downward angled extension providing abutted emgagement against the wrist for steadying the hand-hold of the backboard. This angled extension has a releasable strap for securement to the wrist. The hoop is hingedly connected to the backboard and the handle has a hinge between its ends whereby the hoop and handle can be folded against the backboard for compacting the game for shipment and storage. The handle is removable from the backboard to allow the backboard to be mounted on a stationary support if desired.

5 Claims, 1 Drawing Sheet

BASKETBALL TYPE GAME

BACKGROUND OF THE INVENTION

This invention relates to a new and novel basketball type game.

The conventional game of basketball is played with a backboard that supports a projecting hoop and a net that hangs from the hoop through which the ball passes. This type of game utilizes a stationary backboard mounted on suitable supports. Various types and sizes of backboards and hoops exist ranging from the full conventional basketball size to smaller children's sizes.

SUMMARY OF THE INVENTION

An object of the invention is to provide a basketball-type game that is novel in its structure and function in that in one use thereof the backboard with the hoop attached is capable of being supported by one hand of a person and maneuvered so that a ball traveling toward the person holding the backboard and hoop can with skill of the person be caused to pass through the hoop.

Another object is to provide a game of the type described that can be played in the dark and also can either be hand-held as described or mounted in a stationary position on a support.

According to the present invention, a basketball-type game is provided that utilizes a reduced size ball as well as a reduced size backboard and hoop. The backboard includes a depending handle that allows a person to hold the backboard in an upright position with one hand and maneuver it so that a ball traveling toward the person can by skill of the person be caused to pass through the hoop. The handle has an integral bottom extension selectively angled so as to lie in abutted engagement against the wrist to assist in steadying the person's grasp on the handle. The handle also employs a releasable strap on the angled extension that locks the extension on the wrist. The handle has hinge means intermediate its ends to compact it behind the backboard for shipment and storage and is also removable from the backboard to provide a double use of the backboard, namely, in an anchored position on a stationary support or portable use in a wrist mounted position. The assembly has luminous portions of light charging characteristics for playing of the game in the dark.

The invention will be better understood and additional objects and advantages will become apparent from the following description taken in connection with the accompanying drawings.

DETAILED DESCRIPTION OF A PREFERRED EMBODIMENT

Figure 1:
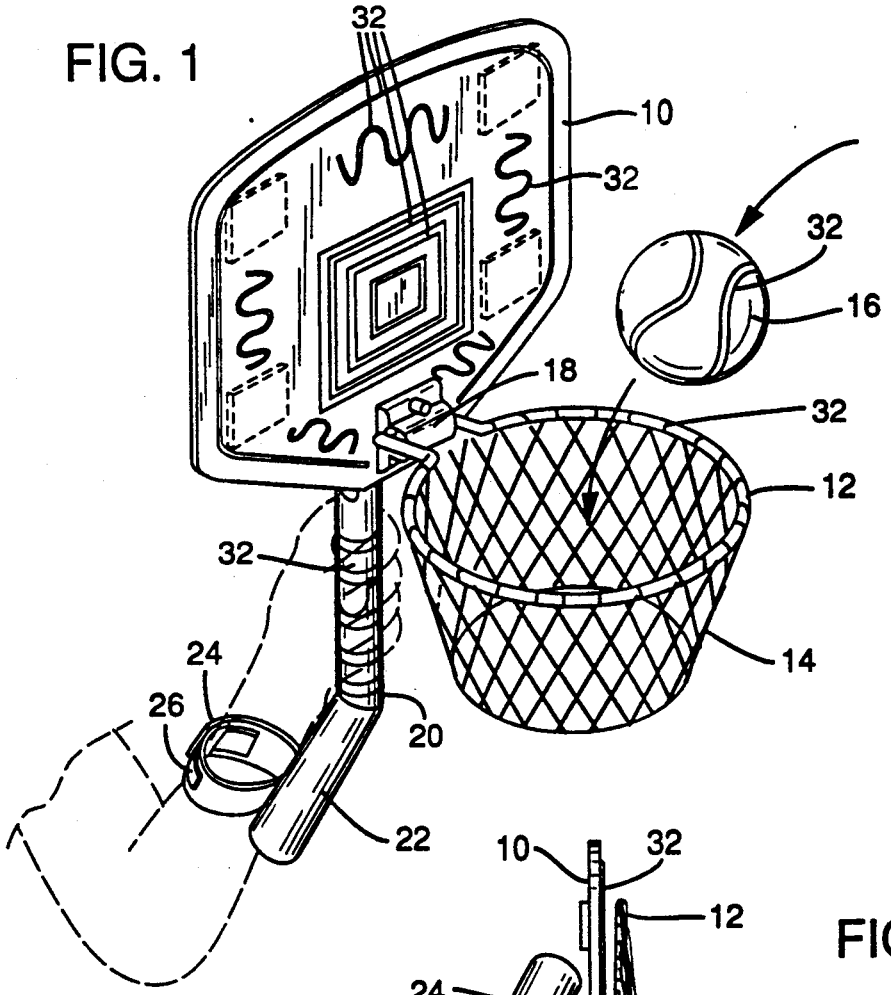
FIG. 1 is a perspective view of the device.
Figure 2:
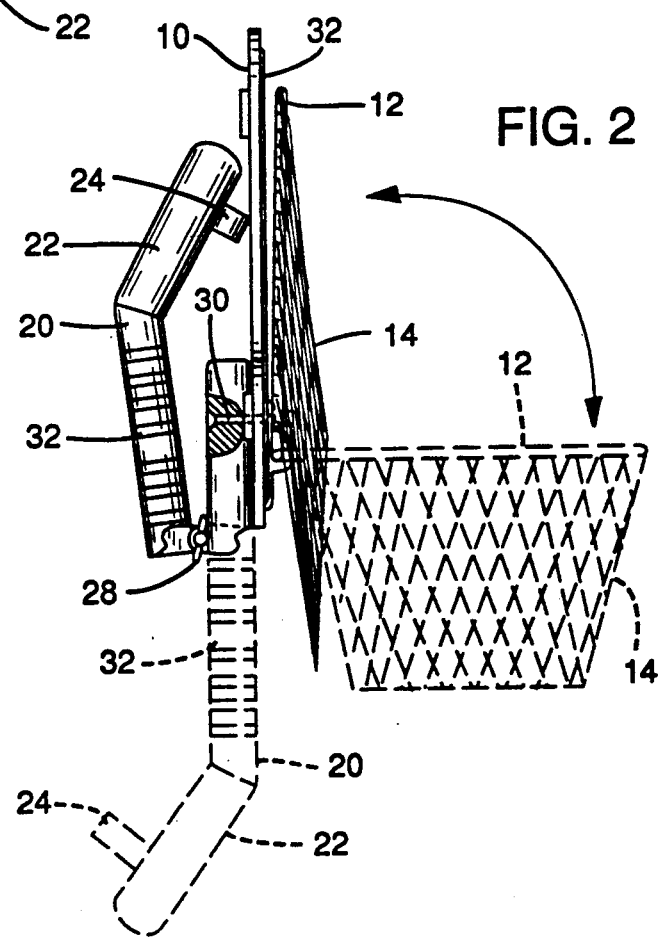
FIG. 2 is a side elevational view showing in particular the structure of the handle and a folded condition of the device.

With particular reference to the drawings, the device comprises a backboard 10 with a hoop 12 projecting from the face of the backboard, and a net 14 on the hoop. For the purpose of this invention, the backboard and hoop are of reduced size and are associated with a correspondingly reduced size untethered ball 16. Hoop 12 is connected to the backboard by a conventional two position hinge 18 that either supports the hoop in an outward projecting position at a right angle to the backboard as shown in full lines in FIG. 1 and broken lines in FIG. 2, or a folded up position flush against the backboard, as shown in full lines in FIG. 2 for shipment and storage. A depending handle 20 is secured centrally to the bottom of the backboard which allows a person to hold the backboard by one hand for maneuvering it and causing an approaching ball to pass through the hoop. This handle is constructed of or coated with a friction grip material such as rubber or foam plastic so that a positive hold can be maintained thereon.

The handle has an integral downwardly and rearwardly angled extension 22 also constructed or covered with a friction material. This extension is selectively angled so that when a person has a grip on the handle 20, the extension will lie against the wrist of the person and provide a steadying anchor of the backboard on the arm in combination with the person's grip on the handle. Angled extension 22 has a strap 24 anchored thereon arranged for removable connection around the wrist to provide securement of the extension to the wrist. Releasable connection of the strap 24 is provided by suitable means 26, such as Velcro.

The handle 20 includes a bolt-type hinge 28 between its ends which can securely hold the bottom portion of the handle in its down position or it can be loosened to allow this bottom portion to be rotated up to be compacted at the back of the backboard in a locked position, thus reducing the size of the assembly for shipment and storage.

Handle 20 is removably attached to the backboard, such as by screws 30 whereby upon detachment of the handle, the backboard can be anchored to a stationary support for playing basketball in the usual manner.

In a preferred structure, luminous portions, such as strips or other designs of luminous paint, are provided on the backboard, the hoop, the net, the handle, and the ball, whereby upon being charged with light the game will glow in the dark. The game can be played by a single person by tossing a ball up in the air and maneuvering the backboard such that as the ball descends it will travel through the hoop, or the game can be played with two or more persons tossing a ball between them.

It is to be understood that the form of my invention herein shown and described is to be taken as a preferred example of the same and that various changes in the shape, size and arrangement of parts may be resorted to without departing from the spirit of my invention, or the scope of the subjoined claims.

Having thus described my invention, I claim:

1. A basketball-type game comprising:

a reduced size ball, a reduced size backboard having a face surface, a hoop supported on the face surface of said backboard in angular relation, and a handle depending integrally from said backboard by means of which a person can grasp and hold the backboard and hoop in an upright position with one hand and maneuver it so that said ball when approaching the person can by skill of the person be caused to pass through the hoop, said handle including an integral downward extension on a lower portion thereof angled relative to said handle so as to lie in abutted engagement against the wrist when said handle is gripped in the hand for playing.

2. The game of claim 1 including a releasable strap on said downward extension arranged to encircle the person's wrist and lock said extension on the wrist.

3. The game of claim 1 including hinge means between upper and lower ends of said handle for folding a portion of said handle rearwardly against said backboard for compacting it when not in use.

4. A basketball-type game comprising:

a reduced size untethered ball, a reduced size backboard having a face surface, a hoop and net assembly supported on the face surface of said backboard in angular relation, a handle deepening integrally from said backboard by means of which a person can grasp and hold the backboard and hoop in an upright position with one hand and arm and maneuver it so that said ball when approaching the person can by skill of the person be caused to pass through the hoop, luminous means on the face surface of said backboard, luminous means on said ball, and luminous means on said hoop and net assembly.

5. The basketball-type game of claim 4 including an integral downward extension on a lower portion of said handle, and a releasable strap on said downward extension arranged to encircle a person's arm and lock said extension on the arm.

* * * * *